US009076621B2

(12) United States Patent
Lammers

(10) Patent No.: US 9,076,621 B2
(45) Date of Patent: Jul. 7, 2015

(54) ELECTROMAGNETIC ACTUATOR WITH UNDER VOLTAGE RELEASE

(75) Inventor: Arend Lammers, TV Hengelo (NL)

(73) Assignee: EATON INDUSTRIES (NETHERLANDS) B.V., Hengelo (NL)

( * ) Notice: Subject to any disclaimer, the term of this patent is extended or adjusted under 35 U.S.C. 154(b) by 0 days.

(21) Appl. No.: 13/994,153

(22) PCT Filed: Dec. 15, 2011

(86) PCT No.: PCT/EP2011/072898
§ 371 (c)(1),
(2), (4) Date: Jun. 14, 2013

(87) PCT Pub. No.: WO2012/080393
PCT Pub. Date: Jun. 21, 2012

(65) Prior Publication Data

US 2013/0307648 A1 Nov. 21, 2013

(30) Foreign Application Priority Data

Dec. 15, 2010 (EP) ..... 10195260

(51) Int. Cl.

| | |
|---|---|
| ***H01H 7/16*** | (2006.01) |
| ***H01H 75/00*** | (2006.01) |
| ***H01H 77/00*** | (2006.01) |
| ***H01F 7/18*** | (2006.01) |
| ***H01H 71/24*** | (2006.01) |
| ***H01F 7/123*** | (2006.01) |
| *H01H 71/26* | (2006.01) |
| *H01H 83/12* | (2006.01) |

(52) U.S. Cl.
CPC ..... *H01H 71/24* (2013.01); *H01F 7/123* (2013.01); *H01H 71/26* (2013.01); *H01H 83/12* (2013.01)

(58) Field of Classification Search
CPC . H01H 83/12; H01H 2083/205; H01H 71/24; H01H 51/2209; H01F 7/06; H01F 7/081; H01F 7/1638; H01F 7/064; H01F 7/123; H01F 5/00; H01F 5/44
USPC ..... 335/2, 155, 177, 180, 209, 266, 268, 335/220–229, 251, 255, 261
See application file for complete search history.

(56) References Cited

U.S. PATENT DOCUMENTS

| | | | | | |
|---|---|---|---|---|---|
| 506,282 | A | * | 10/1893 | Timmis | 335/261 |
| 4,013,926 | A | * | 3/1977 | Lang et al. | 361/115 |
| 4,641,117 | A | | 2/1987 | Willard | |
| 4,700,161 | A | * | 10/1987 | Todaro et al. | 335/172 |
| 4,859,975 | A | * | 8/1989 | Uetsuhara | 335/230 |

(Continued)

FOREIGN PATENT DOCUMENTS

| | | | |
|---|---|---|---|
| DE | 474087 | C | 3/1929 |
| DE | 1811146 | A1 | 6/1970 |

(Continued)

*Primary Examiner* — Bernard Rojas
(74) *Attorney, Agent, or Firm* — Leydig, Voit & Mayer, Ltd.

(57) ABSTRACT

An electromagnetic actuator has a yoke for guiding a magnetic flux, and a holding plate attached to an actuating member, the holding plate and yoke forming a first magnetic circuit. Furthermore a magnetic flux generation device is provided for generating a magnetic flux in the first magnetic circuit. The magnetic flux generation device has an under voltage release coil electrically connected to an auxiliary voltage source representing the value of a voltage to be monitored.

6 Claims, 2 Drawing Sheets

(56) References Cited

U.S. PATENT DOCUMENTS

| | | | | |
|---|---|---|---|---|
| 6,262,648 | B1 * | 7/2001 | Lammers | 335/229 |
| 6,794,968 | B2 * | 9/2004 | Arnholt | 335/179 |
| 7,598,830 | B2 * | 10/2009 | Bogdon et al. | 335/179 |

FOREIGN PATENT DOCUMENTS

| | | | |
|---|---|---|---|
| DE | 2635096 | A1 | 3/1977 |
| FR | 1532765 | A | 7/1968 |
| WO | 9914769 | A1 | 3/1999 |

* cited by examiner

ELECTROMAGNETIC ACTUATOR WITH UNDER VOLTAGE RELEASE

CROSS-REFERENCE TO RELATED APPLICATIONS

This application is a U.S. national phase application under 35 U.S.C. §371 of International Application No. PCT/EP2011/072898, filed on Dec. 15, 2011, and claims benefit to European Patent Application No. 10195260.4, filed on Dec. 15, 2010. The international application was published in English on Jun. 21, 2012, as WO 2012/080393 A1 under PCT Article 21(2).

FIELD

The present invention relates to an electromagnetic actuator comprising a yoke for guiding a magnetic flux, a holding plate attached to an actuating member, the holding plate and yoke forming a first magnetic circuit, and a magnetic flux generation device for generating a magnetic flux in the first magnetic circuit.

BACKGROUND

International patent publication WO99/14769 discloses an actuator for operating a vacuum switch in a switch gear installation. The actuator is provided with a switch on coil and a switch off coil, and with a permanent magnet for keeping a holding plate locked against a yoke, and against a spring force. Furthermore, a trip device is arranged in the actuator which can counteract the magnet field of the permanent magnet to trip the actuator to an off position using the energy stored in the spring.

An aspect of the present invention provides an improved electromagnetic actuator.

SUMMARY

In an embodiment, the present invention provides an electromagnetic actuator including: a yoke configured to guide a magnetic flux; a holding plate attached to an actuating member; and a magnetic flux generation device. The holding plate and yoke form a first magnetic circuit. The magnetic flux generation device is configured to generate a magnetic flux in the first magnetic circuit. The magnetic flux generation device includes an under voltage release coil electrically connected to an auxiliary voltage source. The auxiliary voltage source supplies a voltage value to be monitored.

BRIEF DESCRIPTION OF DRAWINGS

Aspects of the present invention will be described in even greater detail below based on the exemplary figures. The invention is not limited to the exemplary embodiments. All features described and/or illustrated herein can be used alone or combined in different combinations in embodiments of the invention. The features and advantages of various embodiments of the present invention will become apparent by reading the following detailed description with reference to the attached drawings which illustrate the following.

DETAILED DESCRIPTION

Figure 1:
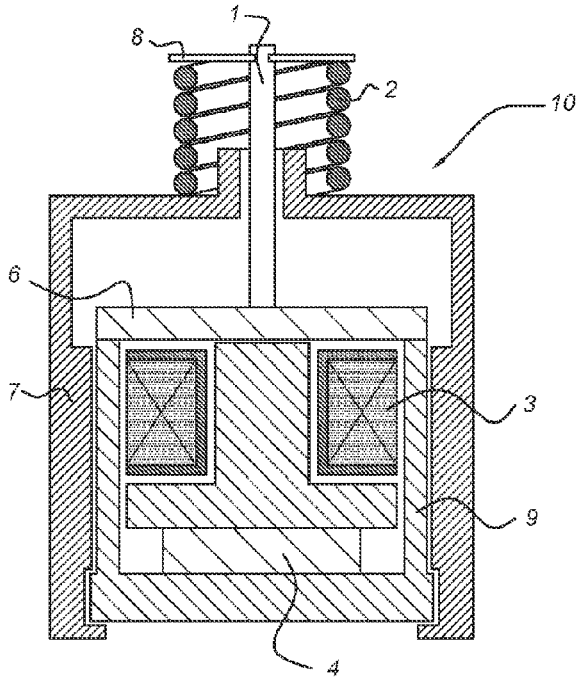
FIG. 1 shows a cross sectional view of an electromagnetic actuator as known in the prior art.

According to the present invention, an electromagnetic actuator is provided, wherein the magnetic flux generation device comprises an under voltage release coil electrically connected to an auxiliary voltage source representing the value of a voltage to be monitored.

This obviates the need for a permanent magnet in the electromagnetic actuator, while at the same time incorporating an under voltage protection function in the electromagnetic actuator.

In a further embodiment, the electromagnetic actuator furthermore comprises a tripping coil, the under voltage release coil being able to generate a magnetic flux in the first magnetic circuit opposing a magnetic flux generated by the tripping coil. Combining an under voltage release coil and a tripping coil in the same magnetic circuit provides a more efficient actuator. In an embodiment, the under voltage release coil has a winding orientation opposite to a winding orientation of the tripping coil. This allows to have opposite working of the different coils according to their intended function. In an even further embodiment, the under voltage release coil is positioned coaxial to the tripping coil, which provides efficient use of available space in the actuator.

In a further embodiment the electromagnetic actuator further comprises a pre-tensioning device (e.g. a spring coil) which exerts a pre-tension force on the holding plate away from the yoke, the under voltage release coil being dimensioned to generate an attraction force holding the holding plate against the yoke, the attraction force exceeding the pre-tension force when the auxiliary voltage exceeds a predetermined threshold value. The under voltage release coil in normal operation then provides a sufficiently high magnetic flux to keep the actuator in the on position. Once the monitored voltage drops below a certain value, the actuator will change to an off position. In an embodiment the pre-tensioning device comprises a mechanical device such as a spring coil, leaf coil, etc.

In a further embodiment, the pre-tensioning device comprises a device external to the electromagnetic actuator, such as a vacuum interrupter which itself is provided with pre-tensioning elements.

The electromagnetic actuator comprises a closing coil for generating a magnetic flux in a second magnetic circuit, the second magnetic circuit being separate from the first magnetic circuit. Keeping the second magnetic circuit separate prevents any possible interference with another function of the actuator as described above.

The auxiliary voltage source is an auxiliary voltage supply available in a switch gear installation in a further embodiment, the auxiliary voltage supply providing a voltage representative for the switch gear installation main voltage. This allows efficient use of available elements in the switch gear to enable proper operation of the present actuator.

In a further aspect, the present invention relates to a switch gear installation comprising an auxiliary voltage supply providing a voltage representing a main voltage of the switch gear installation, and an electromagnetic actuator according to any one of the present invention embodiments.

The present invention embodiments relate to a solution for providing a mechanism for releasing an electromagnetic actuator, e.g. in the form of a tripping circuit and/or an actuator for a circuit breaker (such as a vacuum interrupter), when an under voltage occurs in a switch gear installation. Electromagnetic actuators are widely used in switch gear installations and are usually operated for switching off and on circuit breakers or tripping circuits.

FIG. 1 shows a cross sectional view of a prior art electromagnetic actuator 10, in the form of a tripping actuator. A spring 2 is positioned between an actuator housing 7 and a spring plate 8 which is attached to a trip pin 1. The trip pin 1 is able to trip a tripping device mechanically linked to the trip pin 1 (e.g. to switch off a circuit breaker). The spring 2 is able to store a trip energy which is sufficient to move the pin 1 back to an extended position when the tripping actuator is energized.

The trip energy in the spring 2 is e.g. stored when closing a medium voltage switching device or a tripping device. The trip pin 1 is fixedly attached to a holding plate 6. As shown in the embodiment, a magnetic circuit is formed in a holding plate 6 and a yoke 9. A permanent magnet 4 is positioned in the magnetic circuit, and the magnetic flux thus induced is chosen to be sufficient to hold the holding plate 6 against the yoke 9, despite the force generated by the spring 2.

Furthermore a trip coil 3 is provided which allows to generate an additional magnetic flux in the magnetic circuit. When the additional magnetic flux opposes the magnetic flux generated by the permanent magnet 4 (e.g. by energizing the trip coil 3 with a properly chosen voltage), the holding plate 6 is released. The force of the spring 2 then assures that the trip pin 1 is extended and able to trip a tripping device. This type of tripping actuator has a compact design and requires little trip energy. The tripping actuator 10 has to be charged by an external action, e.g. the closing of a vacuum switch, which allows the holding plate 6 to close the magnetic circuit and to charge the spring 2.

Figure 2:
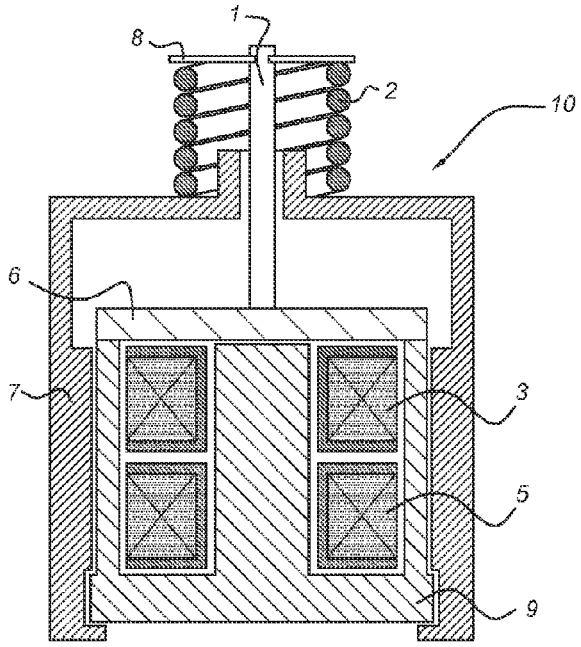
PRIOR ART Fig 2
FIG. 2 shows a cross sectional view of an electromagnetic actuator according to an embodiment of the present invention.

In FIG. 2, a cross sectional view is depicted of an electromagnetic actuator 10 according to an embodiment of the present invention. Again, a housing 7 is provided, as well as a spring 2 and a spring plate 8. A yoke 9 is provided for guiding a magnetic flux in which a tripping coil 3 is positioned. A holding plate 6 is attached to an actuating member in the form of a pin 1 and in energized state of the actuator 10 the holding plate 6 closes a first magnetic circuit with the yoke 9.

In this embodiment, an under voltage protection coil 5 is provided coaxial to the tripping coil 3, the under voltage protection coil 5 implementing a magnetic flux generation device for generating a magnetic flux in the first magnetic circuit. The under voltage protection coil 5 is energized using an auxiliary voltage source of the switch gear in which the actuator is used. The auxiliary voltage source provides a voltage representing the value of a voltage to be monitored. In normal operation, the coil 5 provides the magnetic flux needed in the actuator 10 to hold the holding plate 6 against the yoke 9 (i.e. the coil 5 replaces the permanent magnet 4 in the embodiment shown in FIG. 1).

The magnetic flux generated by the under voltage release coil 5 opposes a magnetic flux generated by the tripping coil 3. This may be implemented by providing the under voltage release coil 5 with a winding orientation opposite to a winding orientation of the tripping coil 3. In the embodiment shown, the under voltage release coil 5 is furthermore positioned coaxial to the tripping coil 3 inside the yoke 9, allowing efficient use of space.

According to IEC62271-1, an under voltage release device shall operate to open a switching device it protects when the voltage at the terminals of the release device falls below 35% of its rated voltage, even if the fall is slow and gradual. On the other hand, it shall not operate the switching device when the voltage at its terminals exceeds 70% of its rated supply voltage. The closing of the switching device protected by the release device shall be possible when the values of the voltage at the terminals of the voltage release are equal to or higher than 85% of its rated voltage. Its closing shall be impossible when the voltage at the terminal is lower than 35% of its rated supply voltage. The present invention embodiments are able to meet these requirements, by properly dimensioning the magnetic circuits and elements, especially the under voltage release coil 5.

In prior art systems, an under voltage release device is a separate device (e.g. mechanically or electrically) linked to the switching device it is intended to protect. An under voltage release device e.g. comprises a spring loaded device that trips a circuit breaker mechanism. When the mechanism fails or the fixation of the under voltage release device is broken, there is no possibility to trip the associated device in case of under voltage.

In normal operation, the coil 5 of the actuator 10 is constantly energized by an auxiliary voltage of the switch gear in which it is used. When the auxiliary voltage drops to 35-70% of the nominal value, the magnetic force generated by the coil 5 which keeps the holding plate 6 against the yoke 9 becomes less than the mechanical force of the spring 2 trying to drive the holding plate 6 away from the yoke 9. This causes the trip pin 1 to move upwards and to trip the medium voltage switch or circuit breaker to which it is connected.

When the coil 5 is energized (normal operation of the switch gear), the trip coil 3 may be energized in a manner opposing or counteracting the magnetic flux generated by the coil 5, in order to release the trip pin 1 due to the force executed by the spring 2.

The actuator 10 according to the embodiment of FIG. 2 may by symmetrical around a longitudinal axis of the actuator 10. The various elements such as the yoke 9 and coils 3, 5 can have a circular (cylindrical) shape. Alternatively, the elements may have a rectangular or other form.

The spring 2 and disc 8 of the electromagnetic actuator embodiment shown in FIG. 2 form a pre-tensioning device which exerts a pre-tension force on the holding plate away from the yoke. The under voltage release coil 5 is dimensioned to generate an attraction force holding the holding plate 6 against the yoke 9, the attraction force exceeding the pre-tension force when the auxiliary voltage exceeds a predetermined threshold value. The spring 2 may take any suitable form, such as a coil spring, or leaf spring.

Figure 3:
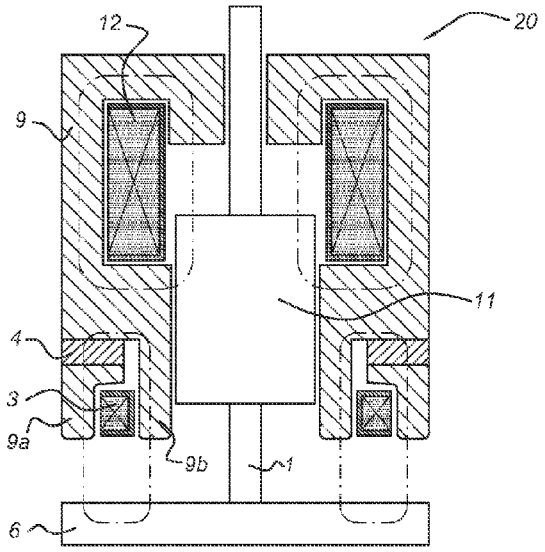
FIG. 3 shows a cross sectional view of an electromagnetic actuator as known in the prior art for operating a vacuum interrupter.

In further embodiment, the pre-tensioning device comprises a device external to the electromagnetic actuator 10, 20. FIG. 3 shows a cross sectional view of an electromagnetic actuator 20 used for operating a vacuum switch in a switch gear. The vacuum switch is provided with a pre-tensioning device which stores energy for switching off the vacuum switch when needed. The force generated by this pre-tensioning device may be used as well in the electromagnetic actuator 20.

A pin 1 is attached to a plunger 11 and a holding plate 6. The assembly of pin 1, holding plate 6 and plunger 11 can move between two positions relative to a yoke 9. A closing coil 12 is provided in the actuator for generating a magnetic flux in a second magnetic circuit which is separate from the first magnetic circuit. When energised, the closing coil 12 attracts the plunger 11, and moves the pin 1 upward thereby switching on a vacuum interrupter or other switching device in the switch gear installation. This is accomplished using the second magnetic circuit through the yoke 9 and plunger 11 indicated by the dash-dot line at the top of the yoke 9 in FIG. 3.

The yoke 9 is formed at its end near the holding plate 6 to have two legs 9*a*, 9*b* and space for a permanent magnet 4, for forming a secondary magnetic circuit in combination with the holding plate 6. The permanent magnet 4 assures the holding plate 6 is kept against the yoke legs 9*a*, 9*b*, withstanding and maintaining contact pressure springs in the vacuum interrupter mechanically linked to the pin 1.

A trip coil 3 is provided which allows to counteract the magnetic flux in the secondary magnetic circuit when properly energized. When energizing the trip coil 3, the magnetic flux in the secondary magnetic circuit is counteracted, allowing the holding plate 6 to come off the yoke legs 9*a*, 9*b*. The electromagnetic actuator 20 itself or the switching device it is connected to may be equipped with force generating means (such as a spring) to force the actuator 20 to its off position.

Figure 4:
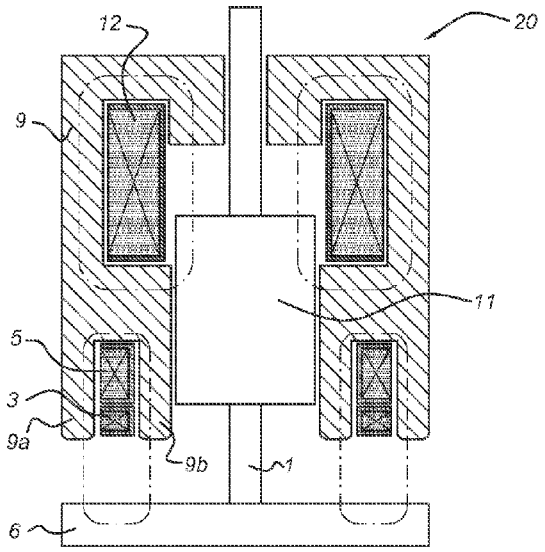
PRIOR ART Fig 4
FIG. 4 shows a cross sectional view of an electromagnetic actuator according to a further embodiment of the present invention.

FIG. 4 shows a cross sectional view of an electromagnetic actuator according to a further embodiment of the present invention. Here, the permanent magnet 4 is no longer present to generate the magnetic flux in the secondary magnetic circuit. Instead, an under voltage release coil 5 is provided in the secondary magnetic circuit. As in the embodiment of FIG. 2, the under voltage release coil 5 may be positioned coaxial to the trip coil 3. Also, the under voltage release coil 5 is connected to an auxiliary voltage representing the voltage to be monitored for the under voltage release functionality. In normal operation, the coil 5 provides the magnetic flux in the secondary magnetic circuit which is needed to hold the holding plate 6 to the yoke legs 9*a*, 9*b* (and the vacuum interrupter linked to the pin 1 in a switched on state).

When the voltage on the terminals of the coil 5 drops below a predefined minimum voltage (representing a threshold value of the voltage to be monitored), the magnetic flux in the secondary circuit decreases as well below the force of the contact pressure springs of the vacuum interrupter, and the electromagnetic actuator 20 will open the vacuum interrupter.

The present invention embodiments of the electromagnetic actuator 20 has the advantage that no additional devices are needed to implement an under voltage protection or under voltage release function in a switch gear installation. The energy needed to energise coil 5 (in the order of several Watts) is not very high, and is usually marginal when compared to the energy transported by the switching device it protects. The electromagnetic actuator 20 with built-in under voltage protection according to the present invention embodiments is also fail safe, as any failure to the coil 5 or associated electrical wiring will bring or keep the associated switching device in the off position.

The dimensions and characteristics of the under voltage release coil 5 depend on the specific application and dimension and characteristics of the other elements used in the electromagnetic actuator embodiments 10, 20, and the associated switch gear or installation it is used in. Determination of dimensions and (magnetic, electrical) characteristics of magnetic circuits and elements thereof are within the reach of the person skilled in the art of electromagnetic actuator technology.

The assembly of the under voltage release coil 5 and trip coils 3 as shown in the exemplary embodiment of FIG. 4 may also be implemented in other types of electromagnetic actuators 20 for vacuum interrupters, e.g. having two operating coils (switch on and switch off coil) in the primary magnetic circuit.

The electromagnetic actuator according to the present invention embodiments provides for a more efficient use of resources in an actuator, such as space and cost.

The electromagnetic actuator embodiments may be used whenever an auxiliary voltage supply is available in a switch gear installation, the auxiliary voltage supply providing a voltage representative for the switch gear installation main voltage. In a further aspect, the present invention relates to a switch gear installation comprising an auxiliary voltage supply providing a voltage representing a main voltage of the switch gear installation, and an electromagnetic actuator according to any one of the present invention embodiments.

The present invention embodiments have been described above with reference to a number of exemplary embodiments as shown in the drawings. Modifications and alternative implementations of some parts or elements are possible, and are included in the scope of protection as defined in the appended claims.

The terms used in the attached claims should be construed to have the broadest reasonable interpretation consistent with the foregoing description. For example, the use of the article "a" or "the" in introducing an element should not be interpreted as being exclusive of a plurality of elements. Likewise, the recitation of "or" should be interpreted as being inclusive, such that the recitation of "A or B" is not exclusive of "A and B." Further, the recitation of "at least one of A, B, and C" should be interpreted as one or more of a group of elements consisting of A, B, and C, and should not be interpreted as requiring at least one of each of the listed elements A, B, and C, regardless of whether A, B, and C are related as categories or otherwise.

The invention claimed is:

1. An electromagnetic actuator, comprising:

a yoke configured to guide a magnetic flux;

a holding plate attached to an actuating member, the holding plate and yoke forming a first magnetic circuit;

a pre-tensioning device which exerts a pre-tension force on the holding plate away from the yoke, the pre-tensioning device comprising a device external to the electromagnetic actuator;

a magnetic flux generation device configured to generate a magnetic flux in the first magnetic circuit, the magnetic flux generation device comprising an under voltage release coil electrically connected to an auxiliary voltage source, the auxiliary voltage source supplying a voltage value to be monitored, and the under voltage release coil being dimensioned to generate an attraction force holding the holding plate against the yoke;

a tripping coil, the under voltage release coil being able to generate a magnetic flux in the first magnetic circuit opposing a magnetic flux generated by the tripping coil; and a closing coil configured to generate a magnetic flux in a second magnetic circuit, the second magnetic circuit being separate from the first magnetic circuit;

wherein the attraction force exceeds the pre-tension force when the auxiliary voltage exceeds a predetermined threshold value.

2. The actuator of claim 1, wherein the under voltage release coil has a winding orientation opposite to a winding orientation of the tripping coil.

3. The actuator of claim 1, wherein the under voltage release coil is disposed coaxial to the tripping coil.

4. The actuator of claim 1, wherein the pre-tensioning device comprises a mechanical device.

5. The actuator of claim 1, wherein the auxiliary voltage source is an auxiliary voltage supply in a switch gear installation, wherein the auxiliary voltage supply provides the voltage value, which is representative for a switch gear installation main voltage.

6. A switch gear installation, comprising:

an auxiliary voltage supply which provides a voltage representing a main voltage of the switch gear installation; and an electromagnetic actuator including:

a yoke configured to guide a magnetic flux;

a holding plate attached to an actuating member, the holding plate and yoke forming a first magnetic circuit;

a pre-tensioning device which exerts a pre-tension force on the holding plate away from the yoke, the pre-tensioning device comprising a device external to the electromagnetic actuator;

a magnetic flux generation device configured to generate a magnetic flux in the first magnetic circuit, the magnetic flux generation device comprising an under voltage release coil electrically connected to an auxiliary voltage source, the auxiliary voltage source supplying a voltage value to be monitored, and the under voltage release coil being dimensioned to generate an attraction force holding the holding plate against the yoke;

a tripping coil, the under voltage release coil being able to generate a magnetic flux in the first magnetic circuit opposing a magnetic flux generated by the tripping coil; and a closing coil configured to generate a magnetic flux in a second magnetic circuit, the second magnetic circuit being separate from the first magnetic circuit;

wherein the attraction force exceeds the pre-tension force when the auxiliary voltage exceeds a predetermined threshold value.

* * * * *